US005282581A

United States Patent [19]

Engelhardt et al.

[11] Patent Number: 5,282,581

[45] Date of Patent: Feb. 1, 1994

[54] YARN END LOOSENING APPARATUS HAVING ADJUSTABLE HEIGHT JET NOZZLES AND A CONTROLLABLE AIR SUPPLY FOR DIFFERENT HEIGHT YARN PACKAGES

[75] Inventors: Dietmar Engelhardt; Heinz-Georg Wassenhoven; Gregor Rüth, all of Mönchengladbach, Fed. Rep. of Germany

[73] Assignee: W. Schlafhorst AG & Co., Moenchengladbach, Fed. Rep. of Germany

[21] Appl. No.: 948,009

[22] Filed: Sep. 21, 1992

[30] Foreign Application Priority Data

Sep. 21, 1991 [DE] Fed. Rep. of Germany ..... 4131482

[51] Int. Cl.[5] ..... B65H 54/00; B65H 67/06

[52] U.S. Cl. ..... 242/35.6 E

[58] Field of Search ..... 242/35.6 E, 35.6 R, 242/18 R, 35.5 R, 35.5 A

[56] References Cited

U.S. PATENT DOCUMENTS

| | | | |
|---|---|---|---|
| 3,236,464 | 2/1966 | Wey | 242/35.6 E X |
| 3,637,148 | 1/1972 | Kupper | 242/35.6 E |
| 4,009,840 | 3/1977 | Müller | 242/35.6 E |
| 4,921,179 | 5/1990 | Surkamp et al. | 242/35.6 E X |
| 5,037,036 | 8/1991 | Okuyama | 242/35.6 E |
| 5,056,726 | 10/1991 | Grecksch et al. | 242/35.6 E X |

*Primary Examiner*—Stanley N. Gibreath
*Attorney, Agent, or Firm*—Shefte, Pinckney & Sawyer

[57] ABSTRACT

A yarn end loosening apparatus is provided for performing yarn end loosening operations on yarn packages. The yarn end loosening apparatus includes a chamber for directing streams of air relative to a yarn package disposed within the chamber to effect loosening of a yarn end from the yarn package. Additionally, the yarn end loosening apparatus includes an assembly for introducing air streams from, respectively, a taller package jet nozzle and a shorter package jet nozzle, the jet nozzles being spaced from one another to each direct a stream of air at the axial location of a type of yarn package having a predetermined axial length. Additionally, the yarn end loosening apparatus includes a device for selectively controlling the supply of air through the taller and shorter package jet nozzles such that only a selected one of the jet nozzles directs air into the chamber during a yarn end loosening operation.

15 Claims, 6 Drawing Sheets

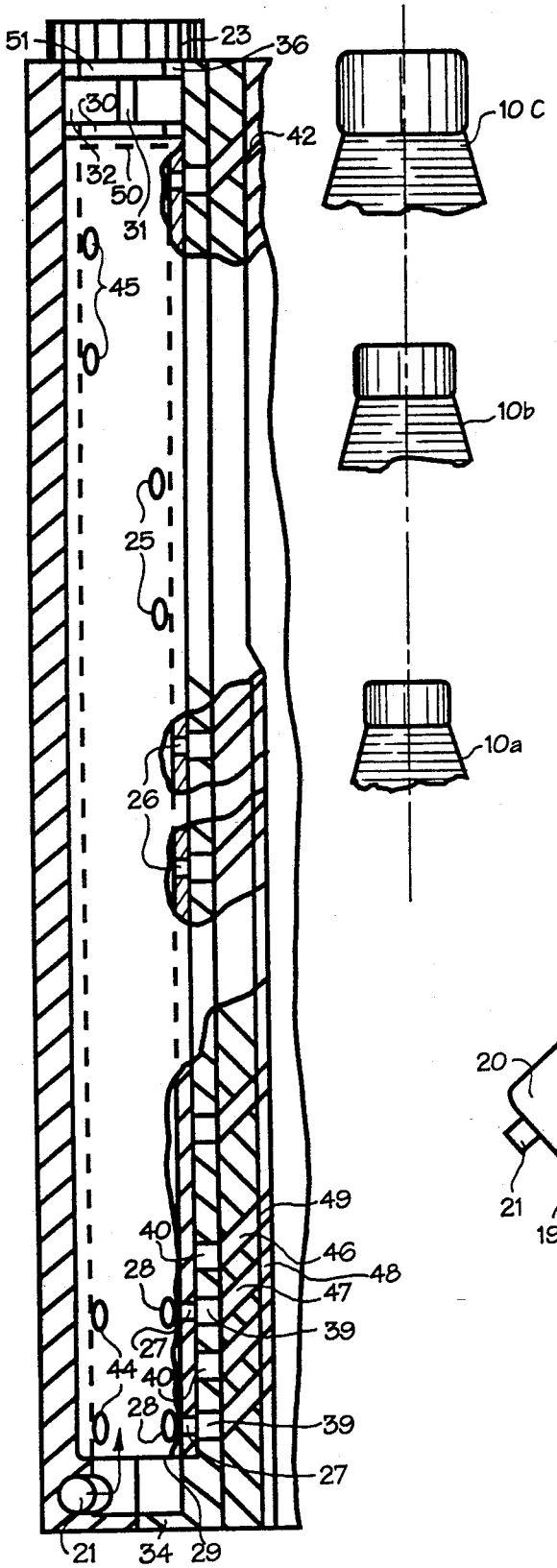
Fig. 3
Fig. 4
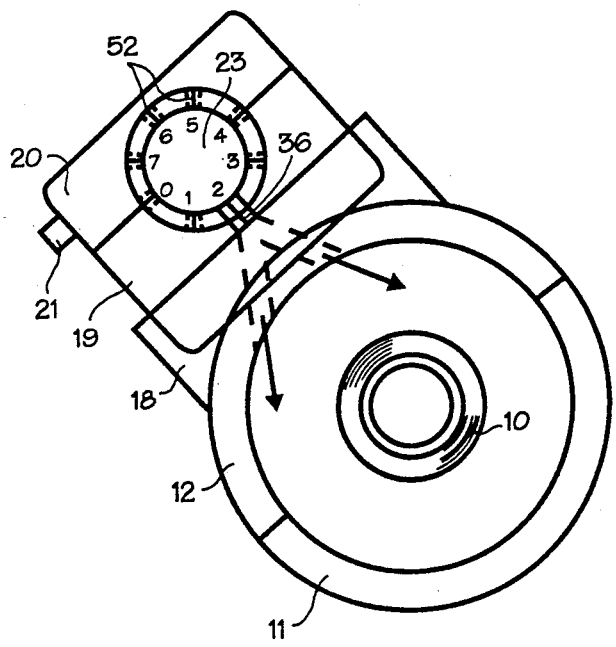

YARN END LOOSENING APPARATUS HAVING ADJUSTABLE HEIGHT JET NOZZLES AND A CONTROLLABLE AIR SUPPLY FOR DIFFERENT HEIGHT YARN PACKAGES

BACKGROUND OF THE INVENTION

The present invention relates to a yarn end loosening apparatus having adjustable height jet nozzles each for directing a stream of air against a yarn package and a controllable air supply to selectively supply the jet nozzles with air according to the height of the yarn package.

In an automatic bobbin winder, yarn packages, which are supplied via an appropriate transport system to an unwinding position at a winding head, are rewound to cross-wound bobbins. To be able to automatically engage the starting end of the yarn of the yarn packages supplied to the winding head to a yarn grasping member of the winding head, this starting end of the yarn must be easy to grasp. So-called yarn package preparation units are known for this purpose which deposit the yarn on a defined position of the yarn package. This starting end of the yarn is then blown out of a yarn end loosening chamber by means of a jet nozzle and can then be taken up. However, such devices are not suitable for taking up again yarn ends after a yarn break on an undefined position on the yarn package surface.

U.S. Pat. No. 4,921,179 to Surkamp et al teaches a yarn supplying unit comprising a yarn end loosening chamber which surrounds the yarn package to be unwound. It comprises in its interior yarn loosening jet nozzles directed tangentially and obliquely upward for generating a current of air directed helically in the direction of unwinding of the yarn. These jet nozzles are supplied with compressed air after the yarn package replacement and after a yarn break. They extend essentially over the entire height of the yarn end loosening chamber. In the case of a relatively large yarn end loosening chamber which is also suitable for correspondingly large yarn packages, a relatively great consumption of air results thereby.

Since a bobbin winding machine must customarily be suitable for rewinding different types of yarn packages which also differ in particular in their dimensions, yarn end loosening chambers must also be used which are set for a maximum yarn package length to be processed. It is necessary, in order to loosen the starting end of the yarn, to blow on the upper tapered portion of the package.

In order to reach this yarn package area with blowing air independently of the yarn package length, all jet nozzles arranged along the yarn end loosening chamber must be operated, leading to a relatively high consumption of compressed air.

SUMMARY OF THE INVENTION

Briefly described, the present invention provides, in one aspect thereof, a yarn end loosening apparatus for performing yarn end loosening operations on yarn packages, each yarn package having a body of yarn formed on a tube and each body of yarn having an upper and lower portion. The yarn end loosening apparatus includes a chamber for directing streams of air relative to a yarn package disposed within the chamber to effect loosening of a yarn end from the yarn package, the chamber having a top and bottom and an axis and being adapted to receive a yarn package therein for a yarn end loosening operation with the upper portion of the yarn package being more closely adjacent the top of the chamber than the lower portion of the yarn package. Also, the yarn end loosening apparatus includes means for introducing air streams into the chamber to effect loosening of a yarn end of a yarn package.

The air stream introducing means has at least one taller package jet nozzle for directing a stream of air into the chamber generally at the axial location of the upper portion of a first type of yarn package and at least one shorter package jet nozzle spaced from the taller package jet nozzle in the direction from the chamber top toward the chamber bottom for directing a stream of air into the chamber generally at the axial location of the upper portion of a second type of yarn package having its upper portion more closely adjacent its lower portion than the first type of yarn package. Also, the air stream introducing means includes means for selectively controlling the supply of air through the taller and shorter package jet nozzles such that only a selected one or more of jet nozzles directs air into the chamber during a yarn end loosening operation.

According to one feature of the one aspect of the present invention, the yarn end loosening apparatus also includes at least one base jet nozzle spaced from the shorter package jet nozzle in the direction from the chamber top toward the chamber bottom for directing a stream of air generally at a lower portion of a yarn package in the chamber during each yarn end loosening operation.

According to another feature of the one aspect of the present invention, the air stream introducing means includes a jet nozzle assembly having a manifold having a plurality of bores each forming a portion of one of the taller and shorter package jet nozzles and the means for selectively controlling the supply of air includes means for adjusting the configuration of the jet nozzle assembly between a taller package configuration in which the taller package jet nozzle introduces a stream of air into the chamber and a shorter package configuration in which the shorter package jet nozzle introduces a stream of air into the chamber. Preferably, the jet nozzle assembly includes a distribution opening assembly having a distribution plate in which a plurality of openings spaced from one another relative to the chamber axis are formed, each opening for guiding a stream of air from the manifold into the chamber and forming a portion of one of the taller and shorter package jet nozzles. Also, the manifold preferably includes a common supply conduit in communication with the taller and shorter package jet nozzles for supplying air thereto, and the means for adjusting the configuration of the jet nozzle assembly preferably includes means for disposing a selected one of the taller and shorter package jet nozzles in communication with one of the distribution plate openings for the introduction of a stream of air therethrough into the chamber while the other of the taller and shorter package jet nozzles is disposed out of communication with the distribution plate openings.

According to additional details of the another feature of the one aspect of the present invention, the taller and shorter package jet nozzles are angularly spaced from one another relative to an axis of the manifold axis. Also, the jet nozzle assembly includes means for movably supporting the manifold for rotation of the manifold about its axis to dispose the selected one of the manifold portions of the taller and shorter package jet nozzles in communication with the distribution plate openings and the means for adjusting the configuration of the jet nozzle assembly is operable to rotate the manifold about its axis to position the selected one of the taller and shorter package manifold jet nozzle portions in communication with the distribution plate jet nozzle portions.

In yet another detail, the yarn end loosening apparatus further includes at least one base jet nozzle spaced from the shorter package jet nozzle in the direction from the chamber top toward the chamber bottom for directing a stream of air generally at a lower portion of a yarn package in the chamber during each yarn end loosening operation, a portion of the base jet nozzle being formed in the manifold such that the base jet nozzle is supplied with air in all rotation positions of the manifold in which the manifold positions the taller and shorter package manifold jet nozzle portions in communication with the distribution plate jet nozzle portions. The portions of the base jet nozzle formed in the manifold preferably include a plurality of angularly spaced bores.

According to an additional further detail of the another feature of the one aspect of the present invention, the air stream introducing means includes a second taller package jet nozzle a portion of which is formed with a bore of the manifold and another portion of which is formed by one of the distribution plate openings a first one of the distribution plate openings is oriented for guiding a stream of air from the manifold into the chamber in a first tangential direction inclined in a first unwinding direction for effecting loosening of the yarn end of a yarn package disposed in the chamber and a second one of the distribution plate openings is axially spaced from the first distribution plate opening and oriented for guiding a stream of air from the manifold into the chamber in a second tangential direction inclined in a second unwinding direction opposite to the first unwinding direction. The first mentioned taller package jet nozzle and a second taller package jet nozzle are axially spaced from one another. Also, the means for adjusting the configuration of the jet nozzle assembly is operable to support the manifold at a first axial position in which the manifold bore portion of the first mentioned taller package jet nozzle is in communication with the first distribution plate opening with the manifold bore portion of the second taller package jet nozzle out of communication with the distribution plate openings and at a second axial position in which the manifold bore portion of the second taller package jet nozzle is in communication with the second distribution plate opening with the manifold bore portion of the first mentioned taller package jet nozzle out of communication with the distribution plate openings.

According to a different feature of the one aspect of the present invention, the air stream introducing means includes a manifold having a plurality of bores spaced from one another and being inclined in a selected unwinding direction and a distribution plate having a plurality of openings axially spaced from one another relative to the chamber axis. Each manifold bore is selectively positionable with one of the distribution plate openings to form one of the taller and shorter package jet nozzles. Also, the yarn end loosening apparatus includes means for selectively communicating a first selection of the manifold bores and the distribution plate openings to form the taller package jet nozzle for directing a yarn end loosening stream of air relative to the first type of yarn packages and a second selection of the manifold bores and the distribution plate openings to form the shorter package jet nozzle for directing a yarn end loosening stream of air relative to the second type of yarn packages.

According to several details of the different feature of the one aspect of the present invention, the manifold includes at least a pair of bores for guiding streams of air in the same unwinding direction and the selectively communicating means includes means for adjustable disposing the manifold at a first axial position in which one of the pairs of bores is communicated with a distribution plate opening to guide a stream of air into the chamber as the taller package jet nozzle with the other bore out of communication with the source of air and at a second axial position in which the other of the pair of bores is communicated with a distribution plate opening to guide a stream of air into the chamber as the shorter package jet nozzle with the one bore out of communication with the source of air. In one configuration, one of the pair of bores is inclined for guiding a stream of air in a first unwinding direction and the other bore is inclined for guiding a stream of air in a second unwinding direction opposite to the first unwinding direction.

According to another advantageous detail of the different feature of the one aspect of the present invention, the means for adjustably disposing the manifold includes a plurality of adjustment holes axially spaced from one another along the distribution opening assembly and at least one insertable pin movably mounted on the manifold for selective insertion and withdrawal from the adjustment holes to adjustably dispose the manifold along the distribution opening assembly.

The arrangement of bores on an adjustable part permits, by means of the adjustment of this part, a rapid and reliable adjustment of the yarn end loosening chamber to the height of the particular yarn packages to be processed. A rotatable manifold can secure the supply of the air to jet nozzles in a certain height thereby by means of the adjusting of a certain angular position. Since one need merely assure that for adjacent adjustments the bores in the manifold must exhibit such an interval from each other that these bores do not overlap, relatively many bores and therewith adjustments to various yarn package lengths can be realized as a function of the circumference of the manifold. The additional possibility of vertical adjustment of the manifold also permits a variation of the tangential directional component of the jet nozzles and therewith the consideration of different directions of winding of the yarn packages.

Also, the alternative use of a carriage which can travel along the yarn end loosening chamber makes possible a simple adjustment of the yarn end loosening chamber to various yarn package lengths. It is also advantageous in this connection that only the carriage must comprise the rather long oblique bores which impart the direction to the current of blowing air whereas the chamber half of the yarn end loosening chamber, which carries the carriage and is normally designed as a cast part, need only comprise large passage openings or even only a through oblong hole for the passage of the blowing air. This results in a considerable simplification of manufacture.

The grid-like arrangement of openings in the chamber half of the yarn end loosening chamber carrying the carriage also assures in this instance that only the bores of the carriage empty into the interior of the yarn end loosening chamber which have the same tangential directional component whereas the remaining bores are covered between the openings.

The possibility of stopping the carriage at different heights also makes possible an exact adjustment of the same.

In order to generate a turbulent flow even on the remaining yarn package parts, the additional provision can be made to activate jet nozzles independently of the yarn package length in the lower yarn package third in every instance. In this manner, e.g., even yarn ends can be loosened which fell down onto the winding after a yarn break. These yarn ends loosened by the lower jet nozzles from the winding surface are then caught by the air flow of the upper yarn loosening nozzles active on the upper tapered portion of the package and are transported further upward to the yarn receiving element.

BRIEF DESCRIPTION OF THE DRAWINGS

FIG. 3 is a side elevational view, in vertical section, of a portion of the yarn end loosening apparatus shown in FIG. 1 and showing the manifold housing, the manifold, and the distribution plate, and schematically illustrating three yarn packages each of a different axial length;

FIG. 4 is a top plan view of the yarn end loosening apparatus shown in FIG. 1;

DESCRIPTION OF THE PREFERRED EMBODIMENT

Figure 1:
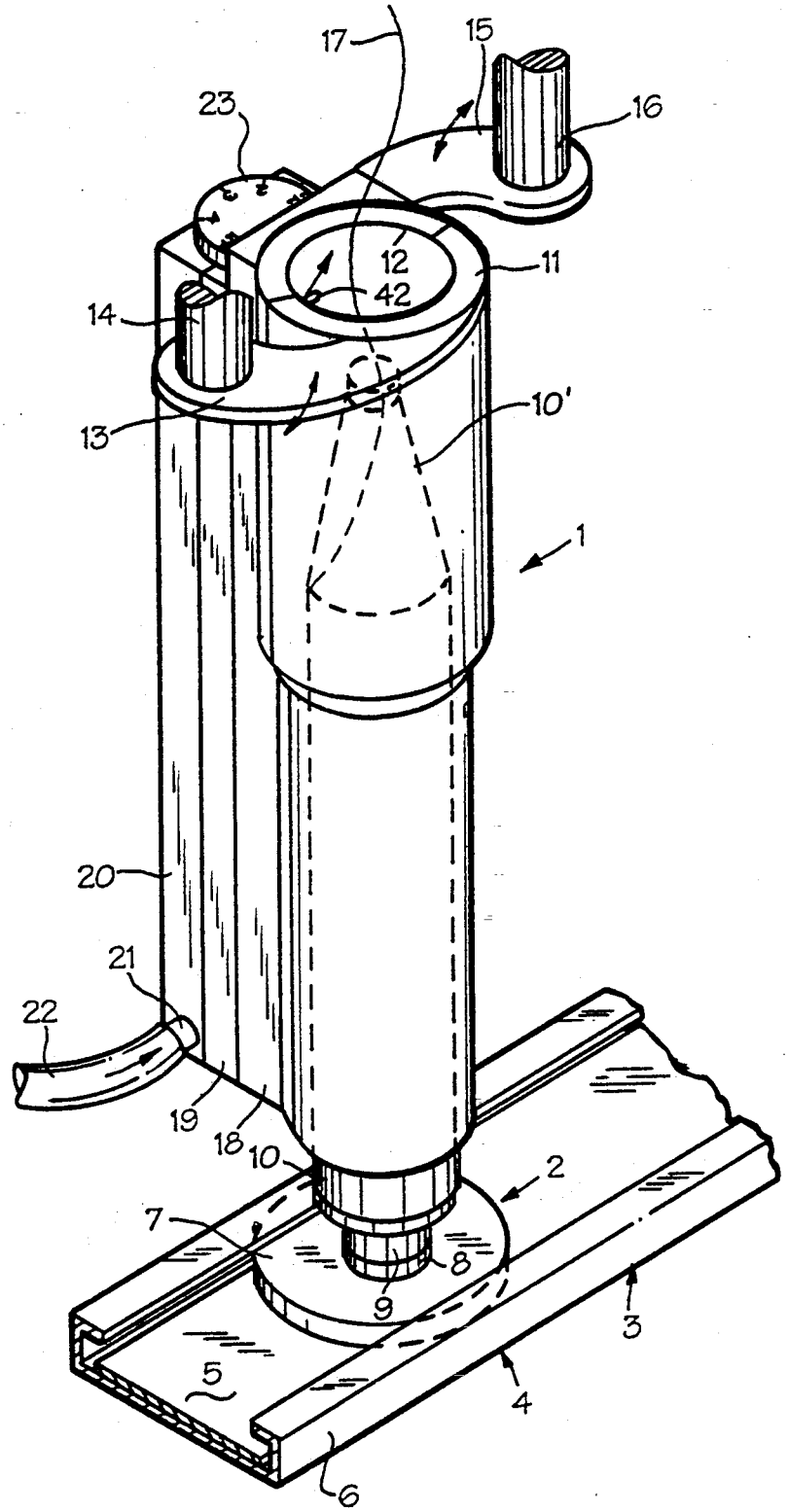
FIG. 1 is a perspective view of one embodiment of the yarn end loosening apparatus of the present invention, showing the apparatus in its yarn package surrounding position during a yarn end loosening operation in which a yarn end is loosened from a yarn package.

A yarn package 10 is located in the view in FIG. 1 in unwinding position 4 of a bobbin winding machine. It is inserted with its manifold 9 onto the insertion pin 8 of a tube support member 2. The tube support member comprises a base plate 7 standing on conveyor belt 5. This conveyor belt 5 runs in transport channel 6 which guides tube support members 2 along transport path 3. This transport path 3 connects a supply belt, which distributes the tube support members with yarn packages to the individual winding heads, to a manifold return belt onto which tube support members 2 are discharged when yarn package 10 has been unwound. For reasons of clarity, a presentation of further parts of the transport system as well as of other tube support members 2 with yarn packages 10 standing ready in front of unwinding position 4 has not been given.

During the unwinding, tube support member 2 is held on the constantly running conveyor belt 5 by means (not shown here) formed by a separate stopper or also by parts of the yarn end loosening chamber 1. The chamber 1 directs streams of air relative to a yarn package disposed within the chamber to effect loosening of a yarn end from the yarn package, the chamber having a top and bottom and an axis and being adapted to receive a yarn package therein for a yarn end loosening operation with the upper portion of the yarn package being more closely adjacent the top of the chamber than the lower portion of the yarn package. After the unwinding, this stop device for tube support member 2 is opened so that conveyor belt 5 can transport the latter from the unwinding position to the manifold return belt.

Yarn end loosening chamber 1 consists of two chamber halves 11,12 held by brackets 13,15. Corresponding brackets can also be arranged on the lower end of both chamber halves 11,12. They have also not been shown for the sake of clarity.

Brackets 13,15 are pivotally mounted on shafts 14,16, as is indicated with double arrows in FIG. 1. Shafts 14,16 are connected to an actuation device of the winding head by means of which they can be sufficiently rotated during yarn package replacement to effect pivoting chamber halves 11,12 out of the transport path to an extent which allows the unwound yarn package to leave unwinding position 4 and a yarn package standing in reserve to run into the unwinding position. A pivoting in the reverse direction then takes place so that chamber halves 11,12 come to rest on one another again, forming yarn end loosening chamber 1.

The yarn end loosening apparatus also includes means for introducing air streams into the chamber to effect loosening of a yarn end of a yarn package, the air stream introducing means having at least one taller package jet nozzle for directing a stream of air into the chamber generally at the axial location of the upper portion of a first type of yarn package, at least one shorter package jet nozzle spaced from the taller package jet nozzle in the direction from the chamber top toward the chamber bottom for directing a stream of air into the chamber generally at the axial location of the upper portion of a second type of yarn package having its upper portion more closely adjacent its lower portion than the first type of yarn package, and means in the form of a manifold 24 for selectively controlling the supply of air through the taller and shorter package jet nozzles such that only a selected one or more of jet nozzles directs air into the chamber during a yarn end loosening operation. A distribution plate portion 18 is located on the outside of chamber half 12. Two manifold housing portions 19,20 are screwed onto this elongated distribution plate portion to form a manifold housing which surrounds manifold 24, which can be fully viewed in the exploded view of FIG. 2 and which only adjustment wheel 23 is visible in FIG. 1.

Air connection 21 is attached to the lower end of manifold housing portion 20 onto which connection a flexible air supply line is inserted which is connected for its part via a switchable valve to a source of compressed air. The yarn end loosening chamber is supplied via this flexible air supply line with the air from a conventional compressed air source (not shown).

As can also be seen in FIG. 1, yarn 17 is supplied through the upper opening of yarn end loosening chamber 1 to the yarn guide members of the winding head. The yarn is unwound thereby from the so-called upper tapered portion of the package 10'. A draw-off accelerator (not shown) for the yarn can also be arranged in addition thereby in the upper area of yarn end loosening chamber 1. The design and operation of such an accelerator are described e.g. in German patent application P 40 30 354.3.

Figure 2:
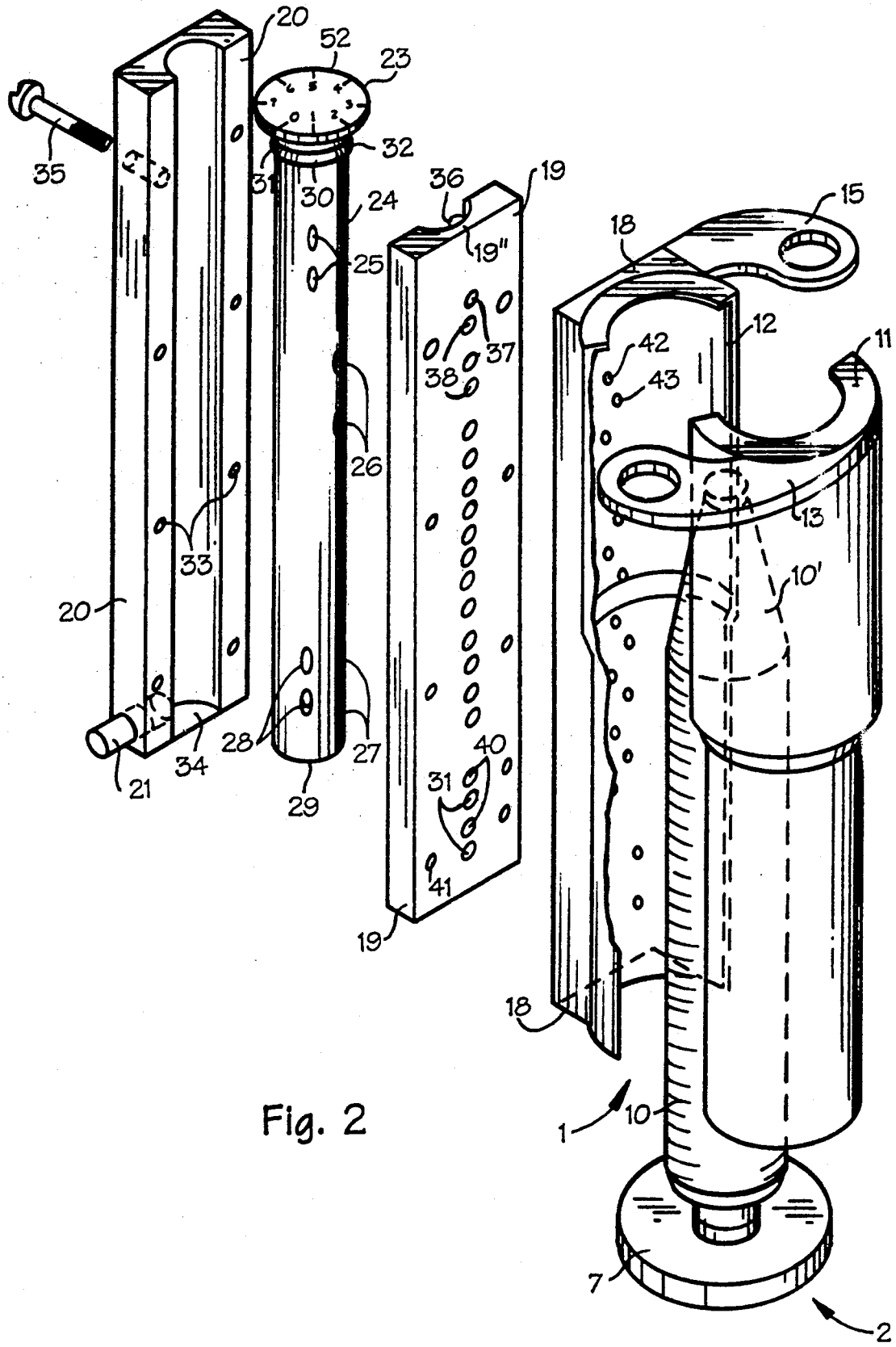
FIG. 2 is an exploded perspective view of the yarn end loosening apparatus shown in FIG. 1.

The specific design of the components for distributing the blowing air in yarn end loosening chamber 1 can be seen in the exploded view of FIG. 2. Openings 42,43 in chamber half 12 are aligned simultaneously obliquely upward and tangentially in various directions. They pass through chamber half 12 and distribution plate portion 18. They alternate with each other in the vertical direction of yarn end loosening chamber 1 down into its lower area. They are provided for different directions of winding of the yarn packages, the so-called P and Q windings. Care should be taken thereby that a tangential directional component is always set which runs in the direction of unwinding of the yarn around the winding surface of the yarn package. The rear ends of openings 42,43 which ends face manifold housing portion 19 are located in a straight line vertically above each other whereas the exit openings on the inside of chamber half 12 run in a zigzag pattern through the tangential directional components.

The manifold housing portion 19 is connected to distribution plate portion 18 to form the distribution plate, air supply bores 37 to 40 of manifold housing portion 19 are located directly on the exit openings of jet nozzles 42, 43, 48 and 49 out of distribution plate portion 18. This assures a through supplying of air.

A plurality of screws 35 which pass through bores 33 in manifold housing portion 20 and bore 41 in manifold housing portion 19 are screwed into threaded bores (not shown) in distribution plate portion 18 which are aligned with bores 33,41 such that the two manifold housing portions 19,20 enclose manifold 24 in an airtight manner. An airtight seal on the bottom is also assured thereby by semicircular parts of a bottom plate 34 attached to the two manifold housing portions 19,20.

Air connection 21 communicates into the manifold housing between this bottom plate 34 and a lower edge 29 of manifold 24. As a result thereof, the air can be supplied into the entire length of the manifold independently of the position of manifold 24, as is also apparent from FIG. 3. This air can only exit through bores 25 to 28 or other bores (not shown in FIG. 2) arranged on the back side of manifold 24 if these bores are aligned with air supply lores 37 to 40 in manifold housing portion 19. This, however, is a function of the angular position of manifold 24.

An adjustment wheel 23 comprises a scale 52 which carries a scale division here of 0 to 7 and is mounted to the top of manifold 24. Each of these scale points is provided for a certain yarn package length. Its value is read, for example, if a covering coincides with a marking 19" on the top of manifold housing portion 19". This marking 19" is arranged over the vertical row of air supply bores 37 to 40 of manifold housing portion 19. Bores are arranged below the particular scale point at a height corresponding to the blowing height which is advantageous for the particular yarn package length. The association of the particular scale values to the yarn package length can be read from a table, which can be attached, e.g., to the yarn end loosening chamber itself. As an alternative, it is also possible to provide scale 52 directly with the yarn package lengths. In this connection, two bores 25 and 26 provided one above the other in the view of FIG. 2 for blowing on the upper tapered portion of the package. However, it can be sufficient to load only one jet nozzle in this area with air or it can be necessary to load more than two jet nozzles with blowing air. The desired number of bores in manifold 24 is to be provided in accordance therewith. For such special variants, positions can generally be provided on manifold 24 if its diameter is so great that sufficient bores can be positioned on its circumference without overlapping.

In addition to directing air on the upper tapered portion of the package, it is also advantageous, as has already been described, to also generate a helical air flow in the lower yarn package third in order to also loosen yarn ends lying on the winding surface of the yarn package. To this end, base jet nozzles spaced from the shorter package jet nozzle in the direction from the chamber top toward the chamber bottom for directing a stream of air generally at a lower portion of a yarn package in the chamber during each yarn end loosening operation or bores 27,28 are distributed on the lower part of manifold 24 over the entire circumference in order to supply air to the jet nozzles through air supply bores 39,40 at every scale position independently of the yarn package length in this area.

As seen in FIG. 3, annular grooves 30,51 are provided on the upper end of manifold 24 above a closure 50 of the manifold and these grooves are separated from one another by a dividing ring 32. The dividing ring 32 is traversed by vertical connection groove 31. This connection groove 31 connects the two annular grooves 30,51.

A guide nose 36, which is fastened to manifold housing portion 19, engages annular grooves 30,51. The particular height of manifold 24 is determined by this guide nose 36, which is arranged alternatively in annular groove 30 or 51. This height brings about the coincidence of bores 25 to 28 with different air supply bores 37 and 40 as well as 38 and 39 in manifold housing portion 19. This selectively causes either jet nozzles 42 or 43 to be supplied with air. This results in the suitability of the two heights of manifold 24 either for yarn packages with P or with Q winding. Thus, within the particular height, all scale divisions on adjustment wheel 23 can be brought into coincidence with marking 19" independently of the direction of winding of the winding of the yarn packages. Connection groove 31 is provided in the zero position on scale 52, as a result of which guide nose 36 can be moved through dividing ring 32 between the two annular grooves 30,51. Consequently, no bores are provided in manifold 24 in this position since it serves exclusively for adjusting the direction of blowing.

As seen in FIG. 3, in addition to bores 25 and 28 in manifold 24, bores 44 in the lower area and bores 45 for the upper tapered portion of the package are found in the manifold. Nozzles 48,49 corresponding to jet nozzles 42 and 43 can also be recognized in the foot area of chamber half 12.

In the position of manifold 24 according to FIG. 3 in position 2 of scale 52 (see FIG. 2), bores 26 operate in the upper area and 27 in the lower area of a yarn package 10*a*, of which only the upper tapered portion of the package is shown here. Scale position 1 would be advantageous for a yarn package 10*b*, in which position bores 25 and 28 form the passage for the blowing air. In scale position 7, bores 44 and 45 operate, as a result of which a special suitability for the yarn package length of a yarn package 10*c* is given.

Figure 5:
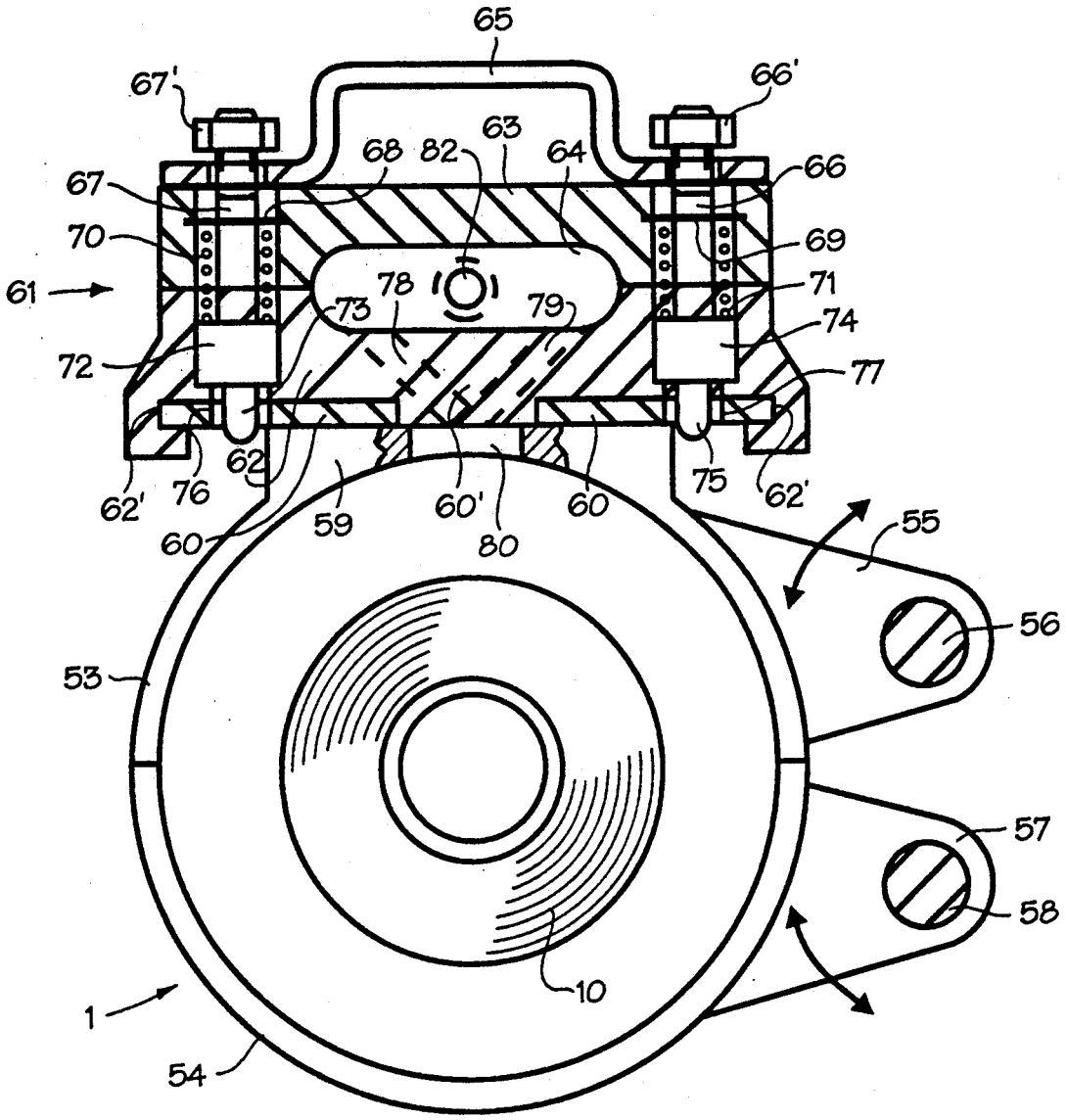
FIG. 5 is a top plan view, in partial horizontal section, of another embodiment of the yarn end loosening apparatus of the present invention.
Figure 7:
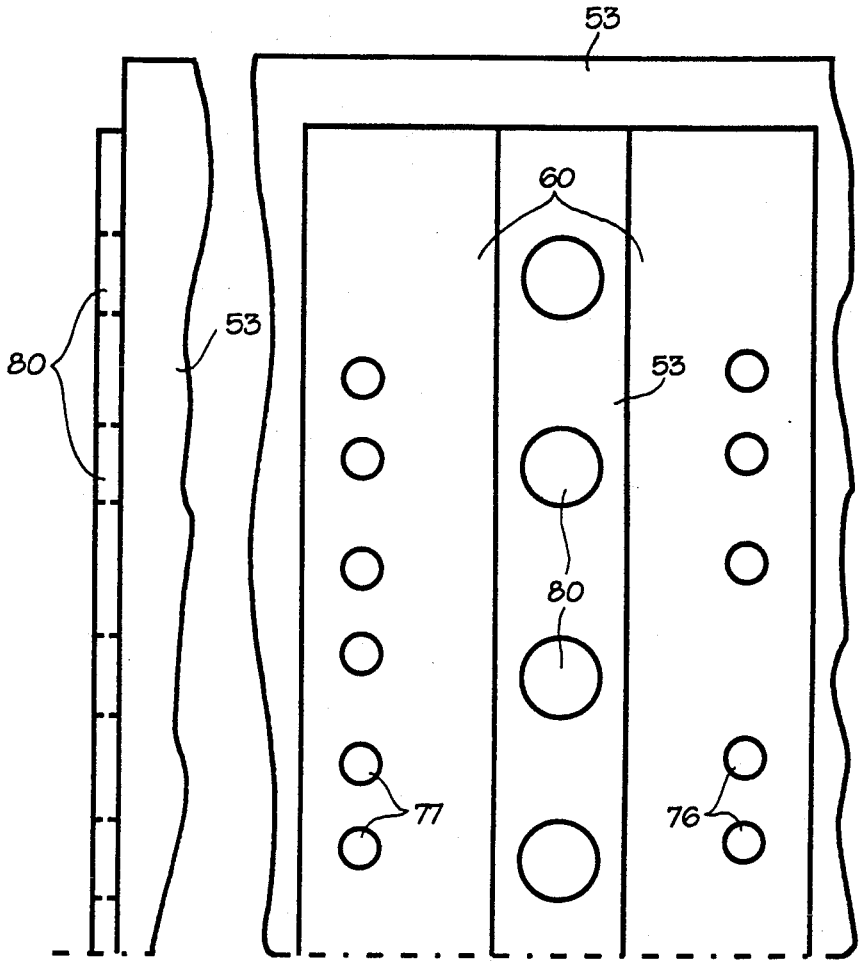
FIG. 7 is a side elevational view, in partial vertical section, of the yarn end loosening apparatus shown in FIG. 5 and showing the movable manifold and the distribution plate thereof.
Figure 7:
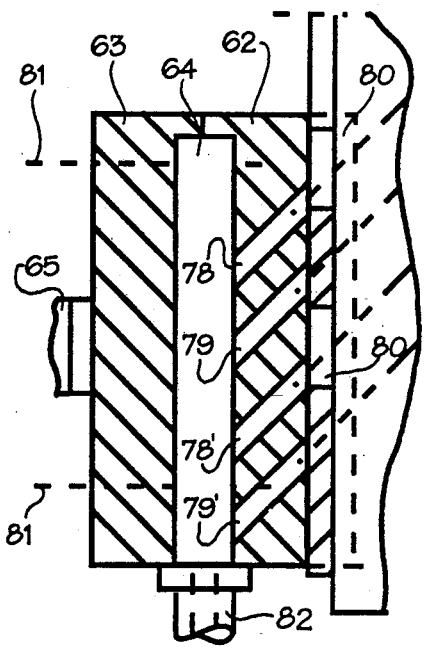
Figure 6:
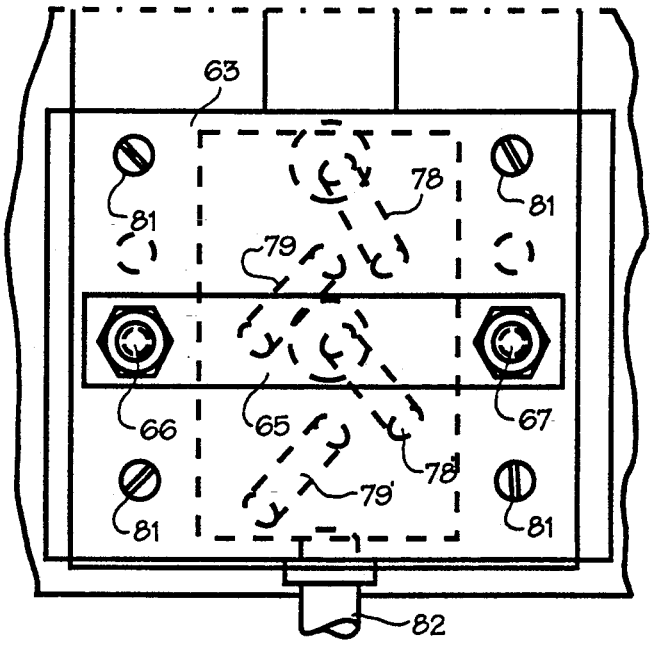
FIG. 6 is a rear elevational view of the yarn end loosening apparatus shown in FIG. 5.

FIGS. 5 to 7 show another embodiment of the design of a yarn end loosening chamber in accordance with the invention. This yarn end loosening chamber, which surrounds yarn package 10 in the winding position as well as during the loosening of the starting end of the yarn, consists here of two chamber halves 53,54. These chamber halves 53,54 are fastened to levers 55,57 which are connected to shafts 56,58. Chamber halves 53,54 are pivoted by pivotal movement of these shafts 56,58.

A distribution plate portion 59 is attached to chamber half 53, which distribution plate portion is connected for its part to a guide plate 60 for guiding an axially movable manifold in the form of a carriage 61. Bore forming portion 62 of carriage 61 comprises grooves 62' which serve to guide it along the longitudinal edges of guide plate 60. This enables carriage 61 to travel vertically along chamber half 53.

A back cover 63 is fastened to bore forming portion 62 of carriage 61 by screws 81, as shown in FIG. 6. Bore forming portion 62 and back cover 63 enclose air conduit 64, which is connected via an air connection 82, a flexible air supply line (not shown) and a valve to a source of compressed air.

Oblique bores 78, 78', 79 and 79' extend from air conduit 64 through bore forming portion 62 and open onto the side facing the interior of the yarn end loosening chamber. In this area, bore forming portion 62 also extends into an opening 60' of guide plate 60 extending along chamber half 53. As a result, only chamber half 53 itself is located between the exit openings of oblique bores 78,79 and 78',79' and the interior of yarn end loosening chamber 1. However, openings 80 are provided above each other in a grid in this chamber half 53.

Oblique bores 78 to 79' determine the direction of the air emptying the chamber and these bores have outlets which open vertically over each other whereas the bore inlets are arranged in offset manner as they open in air conduit 64.

Openings 80 in chamber half 53 are arranged at a uniform spacing which corresponds to the interval of the adjacent outlets of oblique bores 78,78' and 79,79', whose tangential directional component coincides in each instance. As a result, the openings 80 only communicate the air passage into the interior of the yarn end loosening chamber with the oblique bores having the same tangential directional component whereas the other bores are covered and therefore inoperative.

It is likewise possible, although not shown here, to provide carriage 61 solely with bores for one tangential directional component, as a result of which this carriage is suitable only for yarn packages with one direction of winding. For the other direction of winding either the carriage itself or an insertable part containing the oblique bores can be substituted. In this instance openings 80 in chamber half 53 are replaced by a through oblong hole (not separately shown) since no oblique bores have to be covered any more. Alternatively, it is also possible to provide the possibility in carriage 61 of closing the oblique bores of one side in the bore forming portion by a slide. In a variant of the positioning of the oblique bores the bores are arranged in such a manner that they are arranged in a zigzag pattern on the exit side and the position of the oblong hole in chamber half 53 can be adjusted.

A precise positioning of carriage 61 is necessary to assure that the exit openings of the particular oblique bores are not partially covered or that the exit openings are completely covered which correspond to the opposite direction of yarn package winding. Grid bores 76,77 are provided in guide plate 60 in a corresponding grid on both sides of openings 80 in chamber half 53. Carriage 61 includes adjustment bolts 66,67 which are connected to each other via a handle 65. These adjustment bolts 66, 67 comprise support flanges 72,74 for compression springs 70,71 which are supported on their other end against retaining rings 68,69, which are fastened in back cover 63.

Latches 73,75, which can engage into grid bores 76,77, are arranged on the front end of adjustment bolts 66,67. If the carriage position is to be changed, both bolts 66,67 are withdrawn counter to the force of compression springs 70,71 out of their grid positions in grid bores 76,77 via the handle 65, which is connected via nuts 66', 67' to adjustment bolts 66,67. Carriage 61 can then be readily shifted when handle 65 is drawn out and be repositioned. In the new position, latches 73,75 engage into the particular grid bores 76,77 anew, which unambiguously determines the new position of carriage 61.

Figure 8:
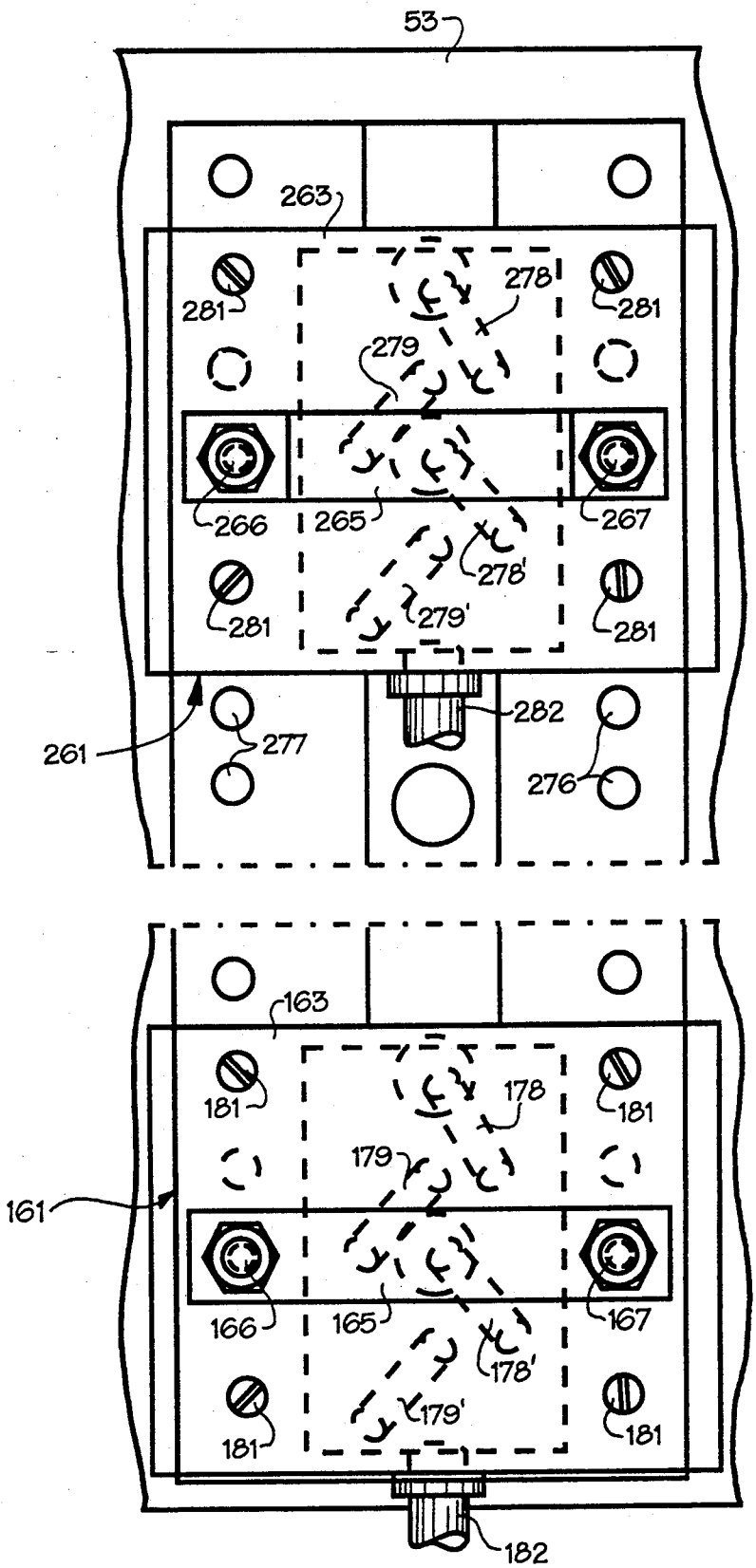
FIG. 8 is a rear elevational view of a variation of the embodiment of the yarn end loosening assembly shown in FIG. 5.

As seen in FIG. 8, the embodiment illustrated in FIGS. 5–7 can be modified to generate a helical air flow in the lower part of the yarn end loosening chamber in addition to the blowing of air onto the upper tapered portion of the package, i.e. another carriage 261 can be provided in addition to a first carriage 161. The carriage 161 can be mounted in a fixed manner or can be releasably mounted in the same manner as the carriage 61. The carriages 161 and 261 each include components identical to the components of the carriage 61 described with respect to FIGS. 5–7 and the corresponding components on carriages 161 and 261 are respectively identified with 100-series and 200-series character reference numbers in FIG. 8.

The positioning of oblique bores which are intended to impart the necessary direction to the current of blowing air in the carriage or carriages simplifies the manufacture of chamber half 53, which is preferably manufactured as a cast part. This chamber half then requires no rather long bores but rather merely the openings 80 or, as described, an oblong hole. These openings can be manufactured in the casting already without significant difficulty and thus require no reworking.

Since a yarn end loosening chamber is preferably provided in a bobbin winding machine at each winding head and the concentration of air is restricted to preferred areas of the yarn packages, there is a noticeable lowering of the energy requirement with simultaneously increased effectiveness of the loosening of yarn. The bobbin winding machines can be used for yarn packages with dimensions which vary considerably from each other without corresponding components having to be replaced.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Yarn end loosening apparatus for performing yarn end loosening operations on yarn packages, each yarn package having a body of yarn formed on a tube and each body of yarn having an upper and lower portion, the yarn end loosening apparatus comprising:

a chamber for directing streams of air relative to a yarn package disposed within the chamber to effect loosening of a yarn end from the yarn package, the chamber having a top and bottom and an axis and being adapted to receive a yarn package therein for a yarn end loosening operation with the upper portion of the yarn package being more closely adjacent the top of the chamber than the lower portion of the yarn package; and means for introducing air streams into the chamber to effect loosening of a yarn end of a yarn package, the air stream introducing means having at least one taller package jet nozzle for directing a stream of air into the chamber generally at the axial location of the upper portion of a first type of yarn package, at least, one shorter package jet nozzle spaced from the at least one taller package jet nozzle in the direction from the chamber top toward the chamber bottom for directing a stream of air into the chamber generally at the axial location of the upper portion of a second type of yarn package having its upper portion more closely adjacent its lower portion than the first type of yarn package, and means for selectively controlling the supply of air through the package jet nozzles such that only a selected one or more of said jet nozzles directs air into the chamber during a yarn end loosening operation.

2. Yarn end loosening apparatus according to claim 1 and further comprising at least one base jet nozzle spaced from the at least one shorter package jet nozzle in the direction from the chamber top toward the chamber bottom for directing a stream of air generally at a lower portion of a yarn package in the chamber during each yarn end loosening operation.

3. Yarn end loosening apparatus according to claim 1 wherein the air stream introducing means includes a jet nozzle assembly having a manifold having a plurality of bores each forming a portion of one of the at least one taller and at least one shorter package jet nozzles, and the means for selectively controlling the supply of air includes means for adjusting the configuration of the jet nozzle assembly between a taller package configuration in which the at least one taller package jet nozzle introduces a stream of air into the chamber and a shorter package configuration in which the at least one shorter package jet nozzle introduces a stream of air into the chamber.

4. Yarn end loosening apparatus according to claim 3 wherein the jet nozzle assembly includes a distribution opening assembly having a distribution plate in which a plurality of openings spaced from one another relative to the chamber axis are formed, each opening for guiding a stream of air from the manifold into the chamber and forming a portion of one of the at least one taller and the at least one shorter package jet nozzles, the manifold includes a common supply conduit in communication with package jet nozzles for supplying air thereto, and the means for adjusting the configuration of the jet nozzle assembly includes means for disposing a selected one of the at least one taller and the at least one shorter package jet nozzles in communication with one of the distribution plate openings for the introduction of a stream, of air, therethrough into the chamber while the other of the at least one taller and the at least one shorter package jet nozzles is disposed out of communication with the distribution plate openings.

5. Yarn end loosening apparatus according to claim 4 wherein the at least one taller and the at least one shorter package jet nozzles are angularly spaced from one another relative to an axis of the manifold axis and the jet nozzle assembly includes means for movably supporting the manifold for rotation of the manifold about ,its axis to dispose the selected one of the manifold portions of the at least one taller and at least one shorter package jet nozzles in communication with the distribution plate openings and the means for adjusting the configuration of the jet nozzle assembly is operable to rotate the manifold about its axis to position the selected one of the at least one taller and the at least one shorter package manifold jet nozzle portions in communication with the distribution plate jet nozzle portions.

6. Yarn end loosening apparatus according to claim 5 wherein the axis of the manifold is generally parallel to the axis of the chamber.

7. Yarn end loosening apparatus according to claim 5 and further comprising at least one base jet nozzle spaced from the at least one shorter package jet nozzle in the direction from the chamber top toward the chamber bottom for directing a stream of air generally at a lower portion of a yarn package in the chamber during each yarn end loosening operation, a portion of the at least one base jet nozzle being formed in the manifold such that the at least one base jet nozzle is supplied with air in all rotation positions of the manifold in which the manifold positions the package manifold jet nozzle portions in communication with the distribution plate jet nozzle portions.

8. Yarn end loosening apparatus according to claim 7 wherein the portion of the base jet nozzle formed in the manifold includes a plurality of angularly spaced bores.

9. Yarn end loosening apparatus according to claim 4 wherein the air stream introducing means includes a second taller package jet nozzle a portion of which is formed with a bore of the manifold and another portion of which is formed by one of the distribution plate openings, a first one of the distribution plate openings is oriented for guiding a stream of air from the manifold into the chamber in a first tangential direction inclined in a first unwinding direction for effecting loosening of the yarn end of a yarn package disposed in the chamber and a second one of the distribution plate openings is axially spaced from the first distribution plate opening and oriented for guiding a stream of air from the manifold into the chamber in a second tangential direction inclined in a second unwinding direction opposite to the first unwinding direction, the at least one taller package jet nozzle and the second taller package jet nozzle are axially spaced from one another, and the means for adjusting the configuration of the jet nozzle assembly is operable to support the manifold at a first axial position in which the manifold bore portion of the at least one taller package jet nozzle is in communication with the first distribution plate opening with the manifold bore portion of the second taller package jet nozzle out of communication with the distribution plate openings and at a second axial position in which the manifold bore portion at least one taller package jet nozzle is in communication with the second distribution plate opening with the manifold bore portion of the at least one taller package jet nozzle out of communication with the distribution plate openings.

10. Yarn end loosening apparatus according to claim 2 wherein the air stream introducing means includes a manifold having a plurality of bores spaced from one another and being inclined in a selected unwinding direction and a distribution plate having a plurality of openings axially spaced from one another relative to the chamber axis, each manifold bore being selectively positionable with one of the distribution plate openings to form one of the at least one taller, and the at least one shorter package jet nozzles and means for selectively communicating a first selection of the manifold bores and the distribution plate openings to form the at least one taller package jet nozzle for directing a yarn end loosening stream of air relative to the first type of yarn packages and a second selection of the manifold bores and the distribution plate openings to form the at least one shorter package jet nozzle for directing a yarn end loosening stream of air relative to the second type of yarn packages.

11. Yarn end loosening apparatus according to claim 10 wherein the selectively communicating means includes means for guiding the manifold axially relative to the distribution openings.

12. Yarn end loosening apparatus according to claim 11 wherein the manifold includes at least a pair of bores for guiding streams of air in the same unwinding direction and the selectively communicating means includes means for adjustable disposing the manifold at a first axial position in which one of the pairs of bores is communicated with a distribution plate opening to guide a stream of air into the chamber as the at least one taller package jet nozzle with the other bore out of communication with the source of air and at a second axial position in which the other of the pair of bores is communicated with a distribution plate opening to guide a stream of air into the chamber as the at least one shorter package jet nozzle with the one bore out of communication with the source of air.

13. Yarn end loosening apparatus according to claim 12 wherein one of the pair of bores is inclined for guiding a stream of air in a first unwinding direction and the other bore is inclined for guiding a stream of air in a second unwinding direction opposite to the first unwinding direction.

14. Yarn end loosening apparatus according to claim 12 wherein the means for adjustably disposing the manifold includes a plurality of adjustment holes axially spaced from one another along the distribution opening assembly and at least one insertable pin movably mounted on the manifold for selective insertion and withdrawal from the adjustment holes to adjustably dispose the manifold along the distribution opening assembly.

15. Yarn end loosening apparatus according to claim 3 and further comprising a base jet nozzle for directing a stream of air onto the chamber against the lower portion of a yarn package and a second manifold having a plurality of bores each forming a portion of the base jet nozzle.

* * * * *